US008393505B2

(12) United States Patent
Coote

(10) Patent No.: US 8,393,505 B2
(45) Date of Patent: Mar. 12, 2013

(54) DUAL FUNCTION PROTECTIVE BABY CARRIER

(76) Inventor: Diana Carol Coote, Kanata (CA)

( * ) Notice: Subject to any disclaimer, the term of this patent is extended or adjusted under 35 U.S.C. 154(b) by 379 days.

(21) Appl. No.: 12/900,467

(22) Filed: Oct. 7, 2010

(65) Prior Publication Data

US 2011/0089205 A1 Apr. 21, 2011

Related U.S. Application Data

(63) Continuation-in-part of application No. 12/128,198, filed on May 28, 2008.

(51) Int. Cl.
*A47D 13/02* (2006.01)

(52) U.S. Cl. ..... 224/160

(58) Field of Classification Search ..... 224/158, 224/159, 160, 161, 245, 196; D3/213, 214
See application file for complete search history.

(56) References Cited

U.S. PATENT DOCUMENTS

| | | | | | |
|---|---|---|---|---|---|
| 3,604,750 | A * | 9/1971 | Doering | 297/467 |
| 4,050,737 | A * | 9/1977 | Jordan | 297/465 |
| 4,333,591 | A * | 6/1982 | Case | 224/160 |
| 4,871,210 | A * | 10/1989 | Alexander et al. | 297/485 |
| 5,848,741 | A * | 12/1998 | Fair | 224/160 |
| 6,010,051 | A * | 1/2000 | Callanan | 224/651 |
| 6,065,655 | A * | 5/2000 | Parewick | 224/158 |
| 6,488,188 | B2 * | 12/2002 | Fleischli | 224/153 |
| 6,598,771 | B2 | 7/2003 | Norman | |
| 6,763,983 | B2 | 7/2004 | Norman | |
| 6,814,405 | B2 | 11/2004 | Norman | |
| 6,851,749 | B2 | 2/2005 | Norman | |
| 7,322,498 | B2 * | 1/2008 | Frost | 224/160 |
| 2004/0238579 | A1 * | 12/2004 | Krogh | 224/160 |
| 2005/0051582 | A1 | 3/2005 | Frost | |
| 2005/0287909 | A1 | 12/2005 | Gelfond | |
| 2007/0066446 | A1 | 3/2007 | Gelfond et al. | |
| 2009/0078729 | A1 | 3/2009 | Coote | |
| 2010/0096419 | A1 * | 4/2010 | Stephens | 224/153 |

* cited by examiner

*Primary Examiner* — Justin Larson
(74) *Attorney, Agent, or Firm* — Patrick Reilly

(57) ABSTRACT

A device and method for carrying and protecting a child in a first arrangement, and for securing a child to a stationary object in a second arrangement, are provided. In one version, the device includes a base panel having an interior side and an exterior side, wherein a crotch panel is deployable from the exterior side. Straps are provided for securing a child between the interior side and a wearer of the device. The device further includes a waist panel that secures the child in place in when carrying the child in the first arrangement, and also for attachment of the device in the second arrangement to a stationary object, such as to a standard sized chair or a seat in a vehicle. A retractable hood is further optionally provided to protect the child's head from neck strain and environmental damage.

19 Claims, 15 Drawing Sheets

DUAL FUNCTION PROTECTIVE BABY CARRIER

CROSS-REFERENCE TO RELATED APPLICATIONS

This application is a Continuation-in-Part of, and claims the benefit of, U.S. Nonprovisional patent application Ser. No. 12/128,198 as filed on May 28, 2008, the contents of which are incorporated by reference herein in their entirety and for all purposes.

FIELD OF THE INVENTION

The present invention relates generally to methods and systems for protecting and carrying human babies, and more particularly to baby carriers.

BACKGROUND OF THE INVENTION

Prior art portable baby carriers are available that allow a user to support maintain a human baby in a position of safety behind the wearer's back or in front of the wearer's diaphragm. These prior art baby carriers typically allow the wearer to protect and transport the baby while generally leaving the wearer's hands to be available and free. In addition to carrying a baby, a care provider of a child will occasionally or often wish to position the baby securely and safely in a stationary location. Yet the prior art fails to provide for a baby carrier child seat that is a deployable for safely securing a child with an external object, yet minimizes interference with the wearer when the carrier is being prepared for use, and used in, carrying the baby.

The prior art also fails to optimally provide for a head protection for a baby when the baby is positioned in a baby carrier and against the wearer's back. The difficulty of reaching behind the baby in this position to deploy, maintain and remove baby head protection without accidently striking the baby's head, or having to remove the baby from the carrier, is unaddressed by the prior art.

Thus, there exists a need for a dual purpose baby carrier. It would be advantageous to have a baby carrier that can provide a capability of safely and securely positioning a baby with an external object, wherein the ease of use of the baby carrier is not degraded by the means to position the baby with the external object.

SUMMARY OF THE INVENTION

This and other objects of the present invention are made obvious in light of this disclosure, wherein a method and device for carrying a human baby are provided. An invented carrier includes means for seating a baby between a human wearer of the carrier an internal side of the wearer. One or more torso straps encircle the wearer in combination with a back panel to hold the baby securely between the wearer and the back panel.

Two shoulder straps may provide the function of a torso strap. A waist strap may further secure the back panel to the wearer by, in combination with the back panel, encircling the wearer's waist. The baby's weight may be at least partially transferred to the wearer's body through the waist strap.

A crotch panel may be deployable in a first arrangement to not interfere with the placement, seating, maintenance and removal of the baby with the carrier, and further positioned in a second arrangement to secure the baby outside of the back panel. A band extend from the crotch panel and, in combination with the crotch panel, encircles the baby and an external object, such as a chair, wherein the interior side of the back panel is disposed between the child and the external object.

In another aspect of the present invention, a method is provided to deploy a baby carrier in a carrying position as worn by a child, adolescent or adult, and alternatively in a securing position to safely position the baby with an external object, wherein the means to secure the baby do not interfere with use of the carrier in the carrying position.

In yet another aspect of the method of the present invention, a retractable cover is provided that may be positioned on and removed from a baby's head while the baby is carried behind the back of a wearer of the carrier. A retractable cord may optionally be provided to assist in removing the head cover from the baby's head while the baby is seated in the carrier and behind the wearer. One or more pull straps may optionally be provided to assist in pulling the head cover over the baby's head while the baby is seated in the carrier and behind the wearer. The carrier may be further configured to enable sustained positioning of the head cover by temporarily coupling of one or more pull straps with a torso strap, such as a shoulder strap.

INCORPORATION BY REFERENCE

All publications mentioned herein are incorporated herein by reference to disclose and describe the methods and/or materials in connection with which the publications are cited. All publications, patents, and patent applications mentioned in this specification are herein incorporated by reference in their entirety and for all purposes to the same extent as if each individual publication, patent, or patent application was specifically and individually indicated to be incorporated by reference.

Such incorporations include United States Patent Application Publication No. 20050051582 (Inventor: Frost, Karin A.; published Mar. 10, 2005) titled "Baby carrier"; United States Patent Application Publication No. 20050287909 (Inventor: Gelfond, Lisa Ellen, published Dec. 29, 2005) titled "Infant mobile"; United States Patent Application Publication No. 20070066446 (Inventors: Gelfond, Lisa Ellen, et al.; published Mar. 22, 2007) titled "Collapsible umbrella gym", and United States Patent Application Publication No. 20090078729 (Inventor: Coote, Diana; published on Mar. 26, 2009) titled "Baby carrier".

Such incorporations further include U.S. Pat. No. 6,598,771 (Inventor: Norman, L.; issued on Jul. 29, 2003) titled "Infant carrier"; U.S. Pat. No. 6,763,983 (Inventor: Norman, L.; issued on Jul. 20, 2004) titled "Infant carrier"; U.S. Pat. No. 6,814,405 (Inventor: Norman, L.; issued on Nov. 9, 2004) Titled "Car seat support member"; and U.S. Pat. No. 6,851,749 (Inventor: Norman, I.; issued on Feb. 8, 2005) titled "Multi-function shopping cart insert".

The publications discussed or mentioned herein are provided solely for their disclosure prior to the filing date of the present application. Nothing herein is to be construed as an admission that the present invention is not entitled to antedate such publication by virtue of prior invention. Furthermore, the dates of publication provided herein may differ from the actual publication dates which may need to be independently confirmed.

BRIEF DESCRIPTION OF THE FIGURES

These, and further features of various aspects of the present invention, may be better understood with reference to the accompanying specification, wherein.

DETAILED DESCRIPTION

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims. Like numbers refer to like elements throughout.

Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1:
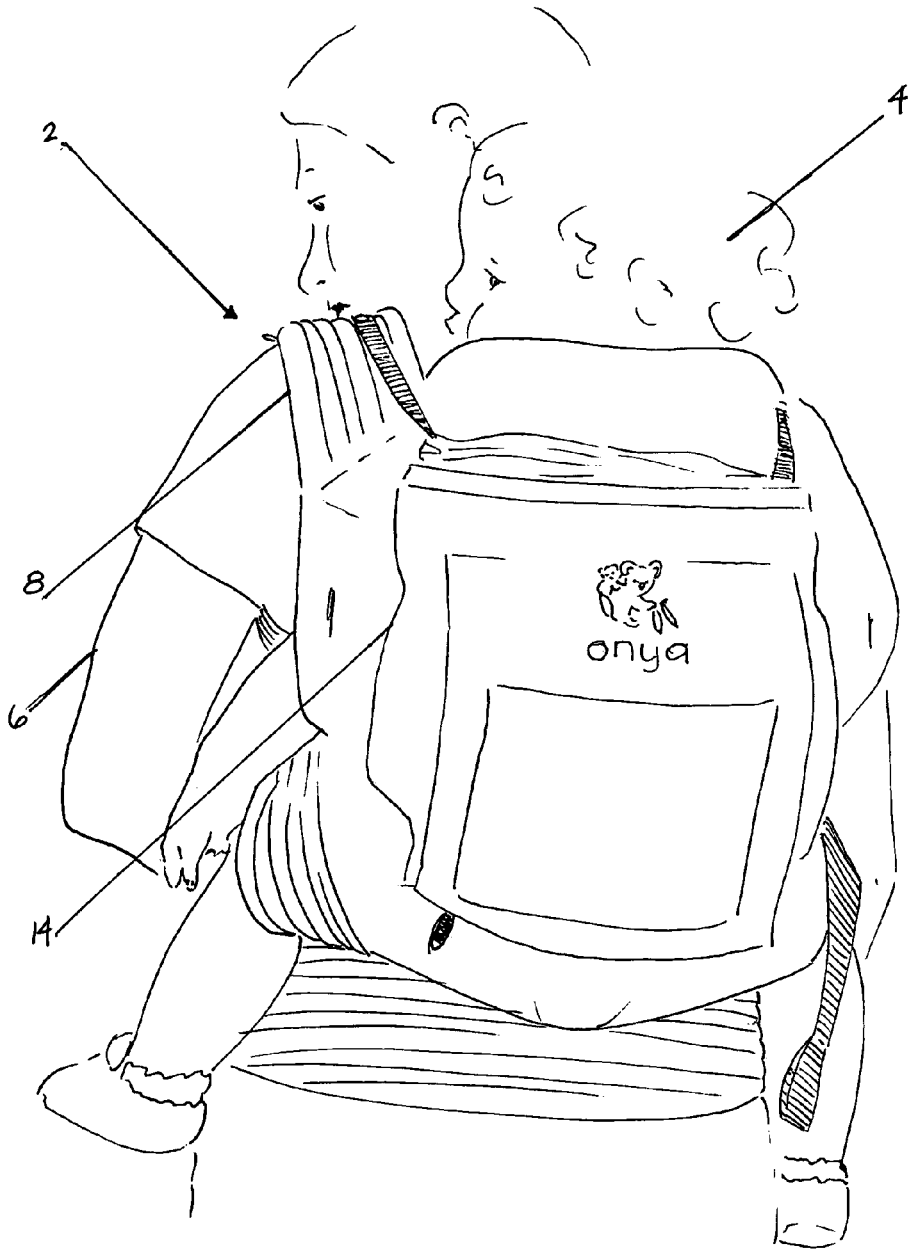
FIG. 1 is a perspective view of a first preferred embodiment of the invented baby carrier (or, "first carrier") in use carrying a baby in a backpack configuration.

FIG. 1 is a perspective view of a first preferred embodiment of the invented baby carrier (or, "first carrier" 2) in use carrying a human baby 4 or baby 4 (hereinafter "baby" 4) in a backpack configuration. FIG. 1 further illustrates the first carrier 2 mounted on and about the torso of a person 6 (hereinafter "wearer") so that the baby 4 is secured in the baby carrier 2 and faces in the same direction as the wearer 6.

Figure 2:
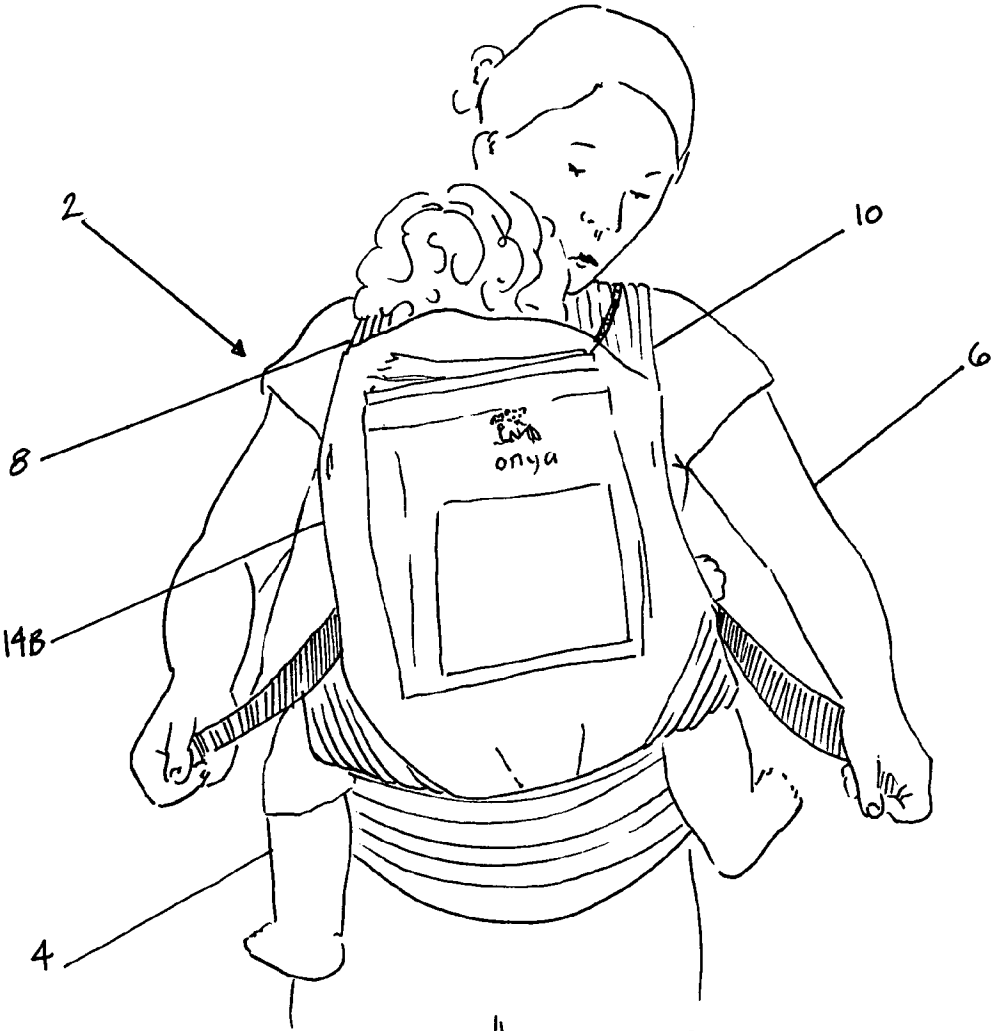
FIG. 2 is a perspective view of the first carrier in use carrying a baby in a front pack configuration.

FIG. 2 illustrates the first carrier 2 mounted upon a front side of the wearer 6 so that the baby 4 faces in the opposite direction of the direction faced by the wearer 6 while the baby 4 is seated in the first carrier 2. In practice, the first carrier 2 may be mounted upon a torso of the preferably adult-sized wearer 6 in a number of ways by, for example, adjusting one or both of arm panels 8 & 10, or "shoulder straps" 8 & 10. As shown in FIG. 5 and FIGS. 6A through 6D, the first carrier 2 is also configurable as a seat harness. As will be described in greater detail below, the first carrier 2 may be configured to secure the baby 4 to an adult-sized chair 12 or other types of chairs and certain external objects. The shoulder straps 8 & 10 are typically designed to withstand the strain of supporting the baby 4 and also reducing the discomfort for the wearer 6. As such, the shoulder straps 8 & 10 may include padding or other features that provide comfort for the wearer 6 of the baby 4. The padding may also afford protection for the back portion of chairs 12 from scratching or the like by the shoulder straps 8 & 10.

Figure 3:
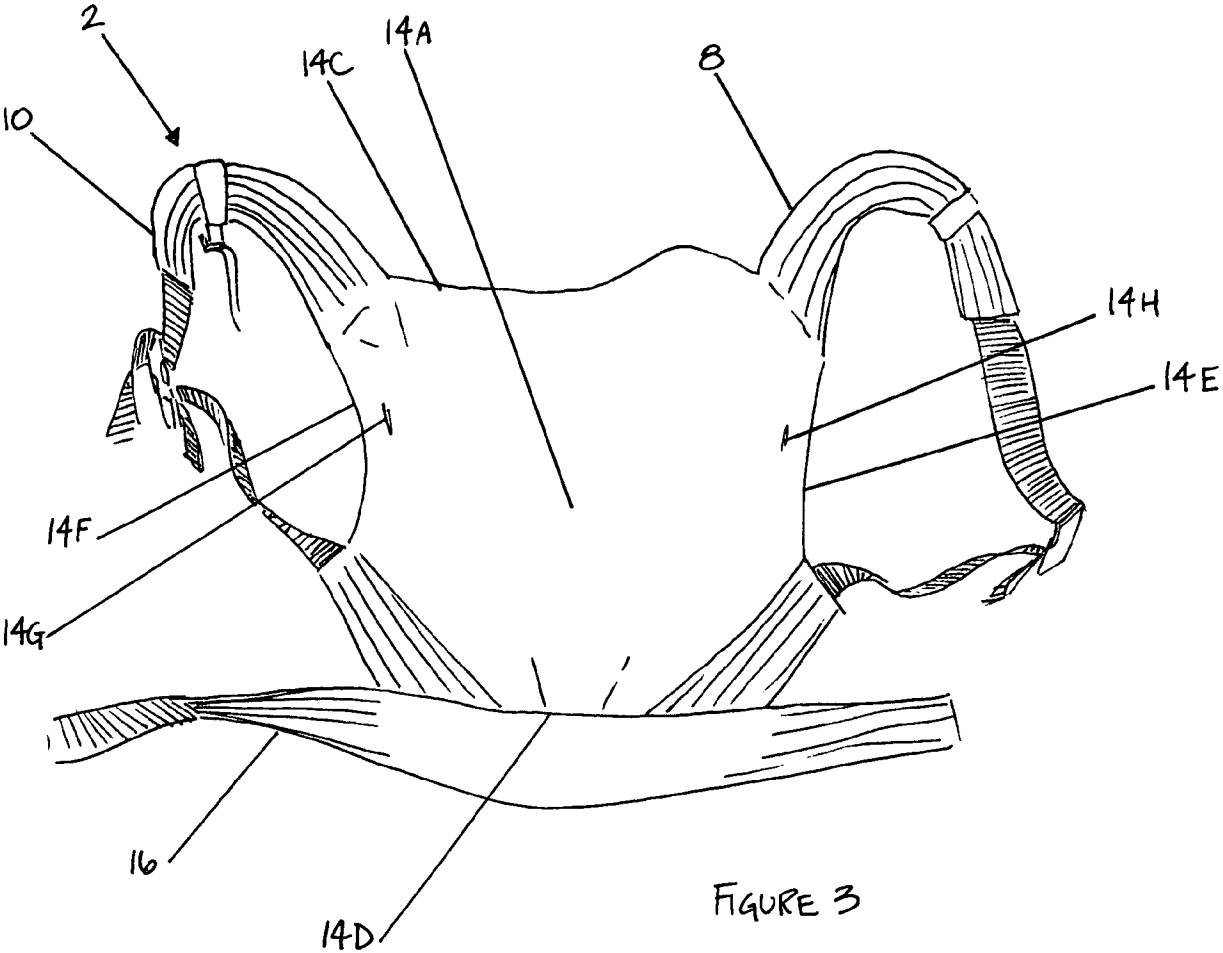
FIG. 3 is a full interior side view of the first carrier.

Referring now generally to the Figures and particularly to FIG. 3, FIG. 3 is a full interior side view of the first carrier 2. A back panel 14 has an interior side 14A, and exterior side 14B as shown in FIGS. 1 and 2. The back panel 14 further is shaped with a top edge 14C, a bottom edge 14D, a left edge 14E and a right edge 14F. The right shoulder strap 10 is attached to the back panel 14 at a right side of the top edge 14C and a right side of the bottom edge 14D. The left shoulder strap 8 is attached at a left side of the top edge 14C and a left side of the bottom edge 14D. A waist strap 16 is attached to the back panel along the back panel bottom edge 14D. The shoulder straps 8 & 10 are each separately adjustable in length to accommodate the size and strap length preference of the wearer 6.

The back panel 14 further comprises a first panel aperture 14G and a second panel aperture 14H through which strapping may be extended, as described below.

Figure 4:
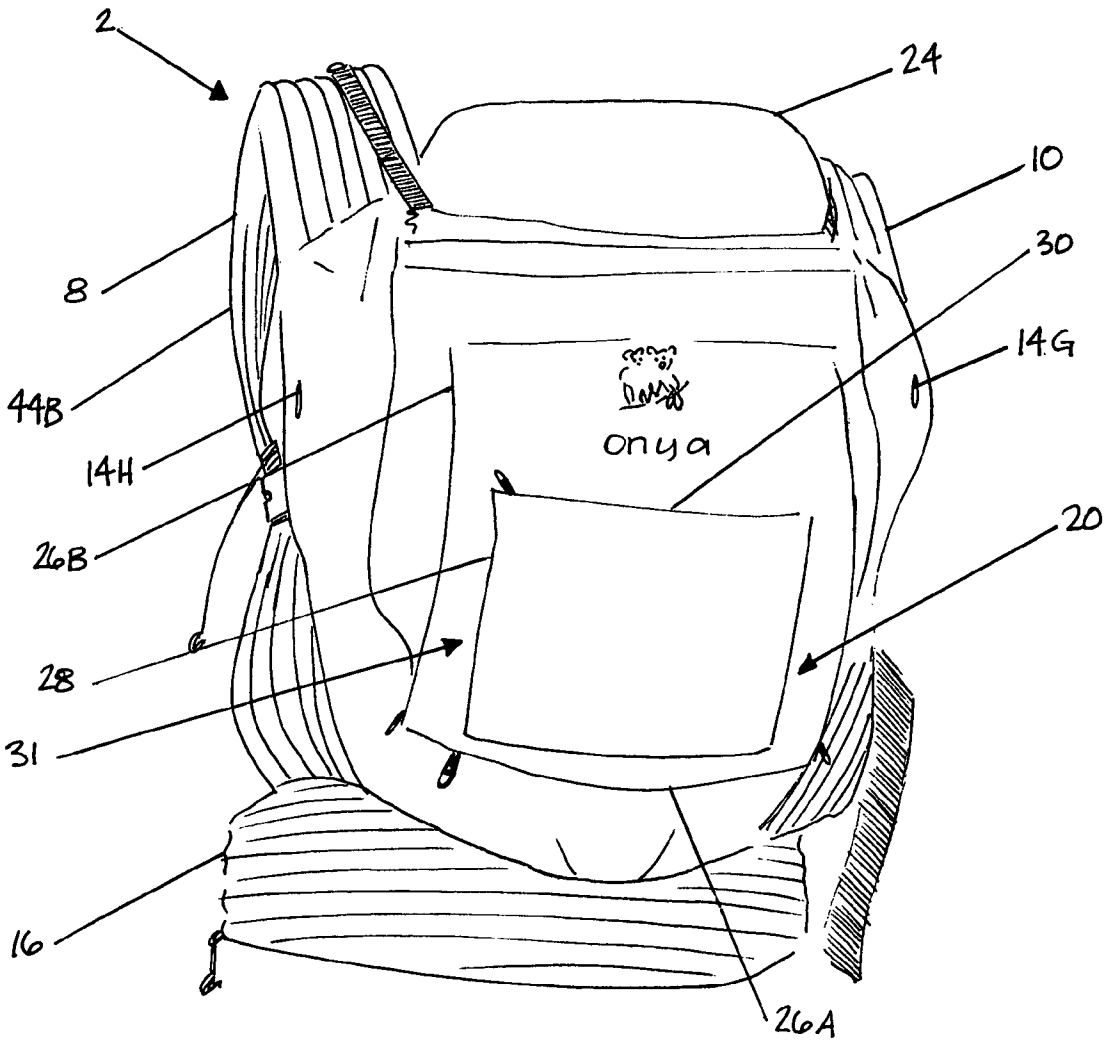
FIG. 4 is a full exterior side view of the first carrier with an exterior seat hidden within a seat pocket and a hood cover hidden from view in a hood pocket.

Referring now generally to the Figures and particularly to FIG. 4, FIG. 4 is a full exterior side view of the first carrier 2 having a deployable seat panel 18 enclosed within a seat pocket 20 and further including a head cover fabric 22 concealed from view in a hood pocket 24. A seat pocket zipper assembly 26A and a seat pocket fabric 26B in combination with the back panel 14 form the seat pocket 20. The seat panel pocket fabric 26B is sewn, adhered or otherwise attached to both the back panel 14 and the seat pocket zipper assembly 26A. The seat pocket zipper assembly 26A is sewn, adhered or otherwise attached to both the back panel 14 and the seat pocket fabric 26B to selectably close and open the seat pocket 20 to alternate store and allow deployment of the seat panel 18 as desired by the wearer.

An exterior pocket fabric 28 is attached to the seat pocket 20 and further comprises a second zipper assembly 30 to form an additional exterior seat pocket 31 for storage of objects and materials. The exterior panel pocket fabric 28 is sewn, adhered or otherwise attached to both the seat pocket fabric 26B and the second pocket zipper assembly 30. The second pocket zipper assembly 30 is sewn, adhered or otherwise attached to both the seat pocket fabric 26B and the exterior pocket fabric 28 to selectably open and close the exterior pocket 31 to alternately store end enable access to the objects and materials as desired by the wearer.

It is understood that the either or both the seat pocket zipper assembly 26A or the second pocket zipper assembly 30 may be replaced or augmented with one or more snap fastener stud and socket matched pairs, VELCRO™ hook and loop fastener elements, as marketed by Velcro USA, Inc. of Manchester, N.H., and/or other suitable fastening elements known in the art.

Figure 5:
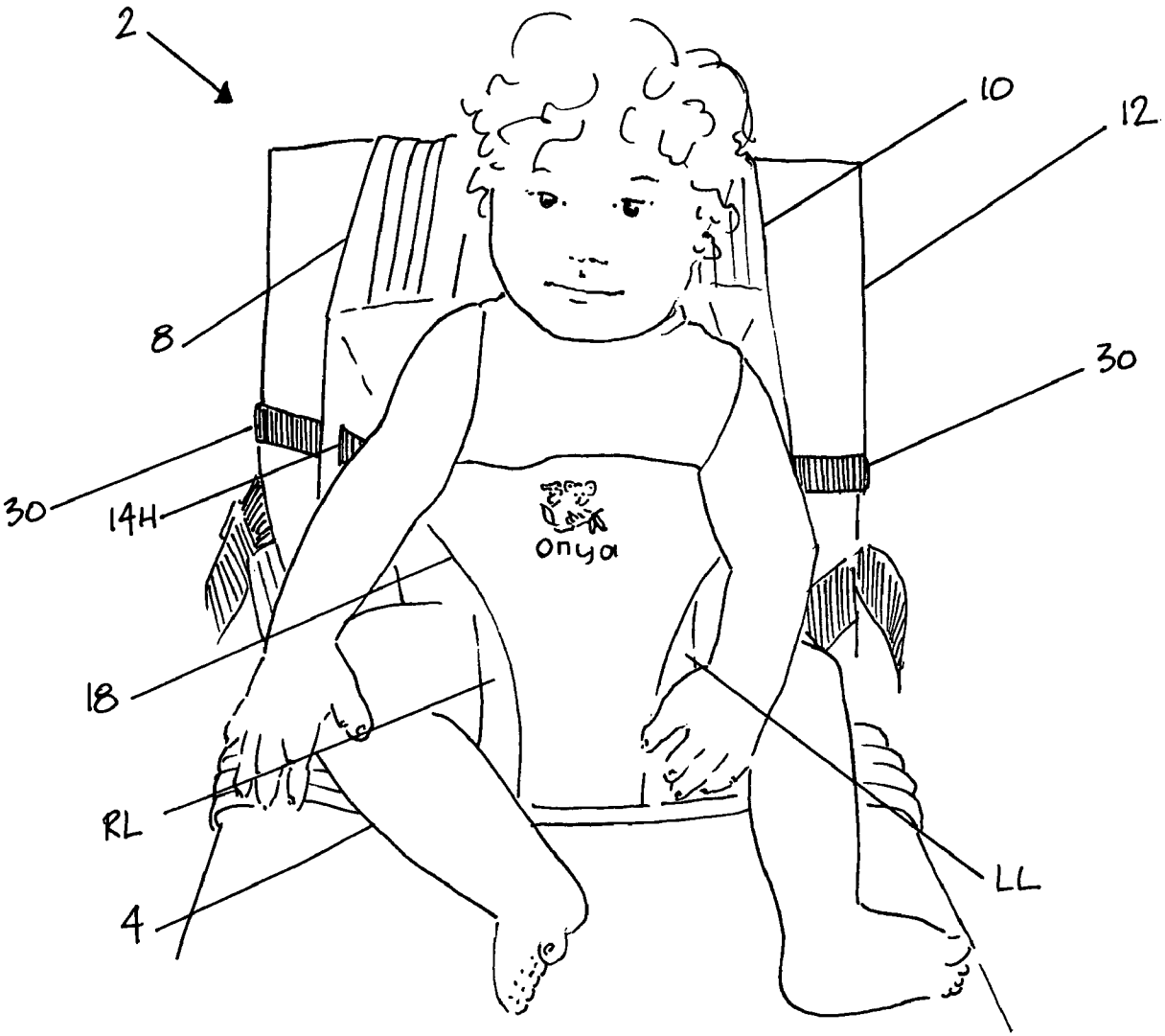
FIG. 5 is a perspective view of the first carrier with the exterior seat deployed.

Referring now generally to the Figures and particularly to FIG. 5, FIG. 5 is a perspective view of the first carrier 2 with the seat panel 18 deployed. In practice, the wearer 6, or other person or care giver, removes the seat panel 18 from the seat pocket 20 and extends an adjustable length band 30 of the seat panel 18 around the chair 12. The shoulder straps 8 & 10 and the waist strap 16 may additionally be positioned to encompass the chair 12 and to temporarily secure the back panel 14 to the chair 12.

The back panel 14 and the seat panel 18 form a left leg aperture LL through which the baby's left leg 4L may extend and a right leg aperture RL through which the baby's right leg 4L may extend.

Figure 6A:
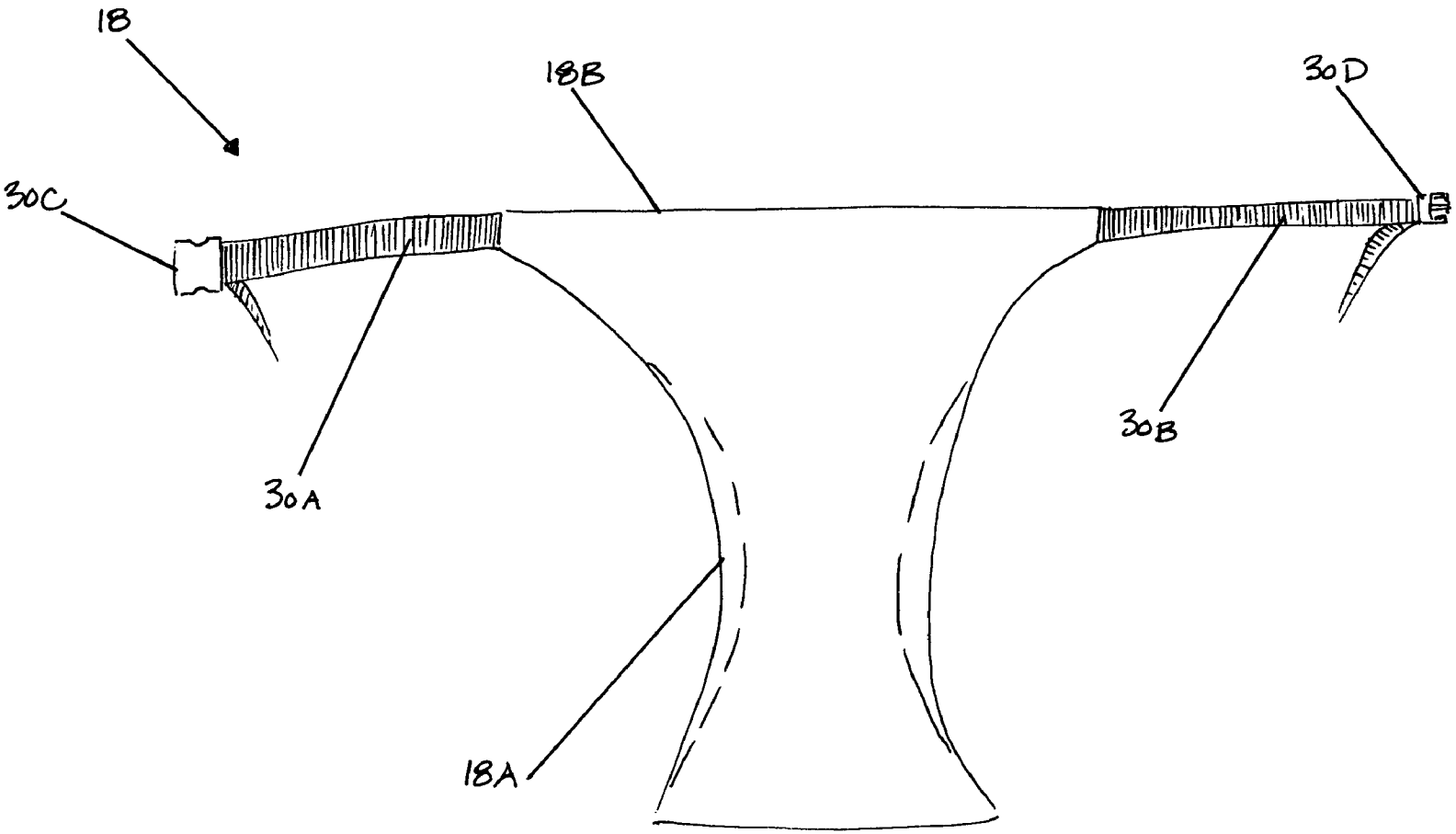
FIG. 6A is an isolated view of the exterior seat.

Referring now generally to the Figures and particularly to FIG. 6A, FIG. 6A is an isolated view of the seat panel 18. The adjustable band 30 includes a right band length 30A, a left band length 30B and a band coupling assembly 30C & 30D, the band coupling assembly 30C & 30D for detachably coupling the right band length 30A and the second band length 30B. When the child 4 is positioned on the chair 12 as shown in FIG. 5, the right band length 30A preferably extends through the first panel aperture 14G and the left band length 30B preferably extends through the second panel aperture 14H.

The band coupling assembly 30C & 30D may additionally enable the length adjustment of the adjustable band 30. In certain alternate preferred embodiments of the present invention, the band coupling assembly 30C & 30D may be a side squeeze buckle assembly, such as selected form a Stealth Warrior™ and Stealth Side™ side squeeze buckle assembly part number pair group of 6403 and 6404; 6358 and 6359; 6581 and 6583; 5614 and 5615; 5616 and 5617; DA003D and DA003K; and DA003Da and DA003Ka as distributed by John Howard Company of Chino, Calif., or other suitable detachable attachment paired elements known in the art.

The seat panel 18 includes seat fabric 18A having a securing edge 18B, wherein the seat fabric 18A is attached back panel 14. The right band length 30A and the left band length 30B are attached to the seat fabric 18A, and the adjustable length band 30 in combination with the seat fabric 18A may be positioned to encircle the back panel 14.

Figure 6B:
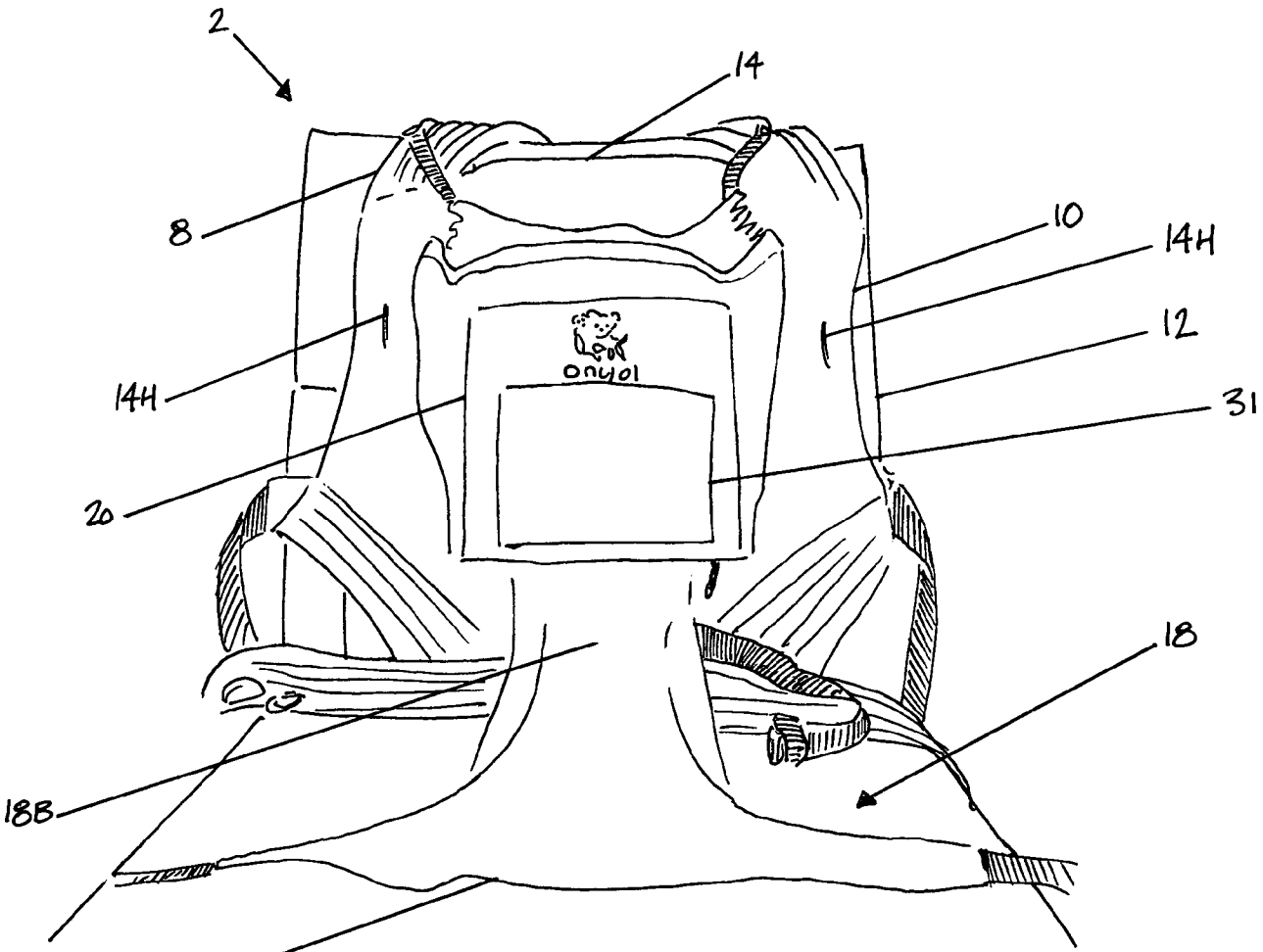
FIG. 6B is a view of a seat panel of FIG. 6A as extending from the back panel of the first carrier and positioned to receive a child.

Referring now generally to the Figures and particularly to FIG. 6B, FIG. 6B is a view of the seat panel 18 as extending from the seat pocket 20 of the back panel 14 and positioned to receive the baby 4. The first carrier 2 is preferably prepared to support the baby 4 by the wearer 6, or other care giver, looping and tightening the left and right shoulder straps 8 & 10 and the waist strap 16 around the chair 12 and thereby detachably coupling these straps 8, 10 & 16 the chair 12.

Figure 6C:
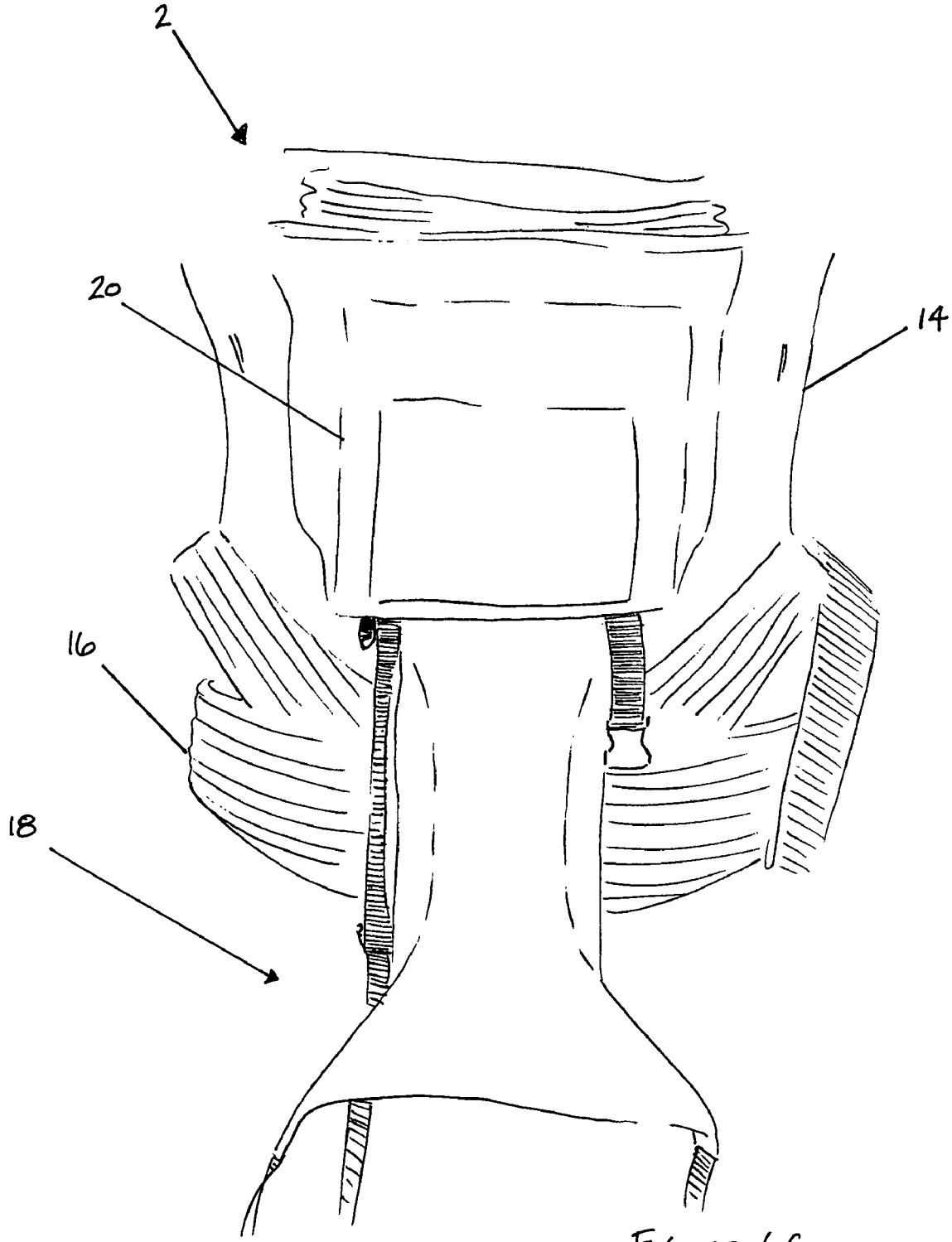
FIG. 6C is another view of a seat panel of FIG. 6A as extending from the back panel of the first carrier and positioned to receive a child.
Figure 6D:
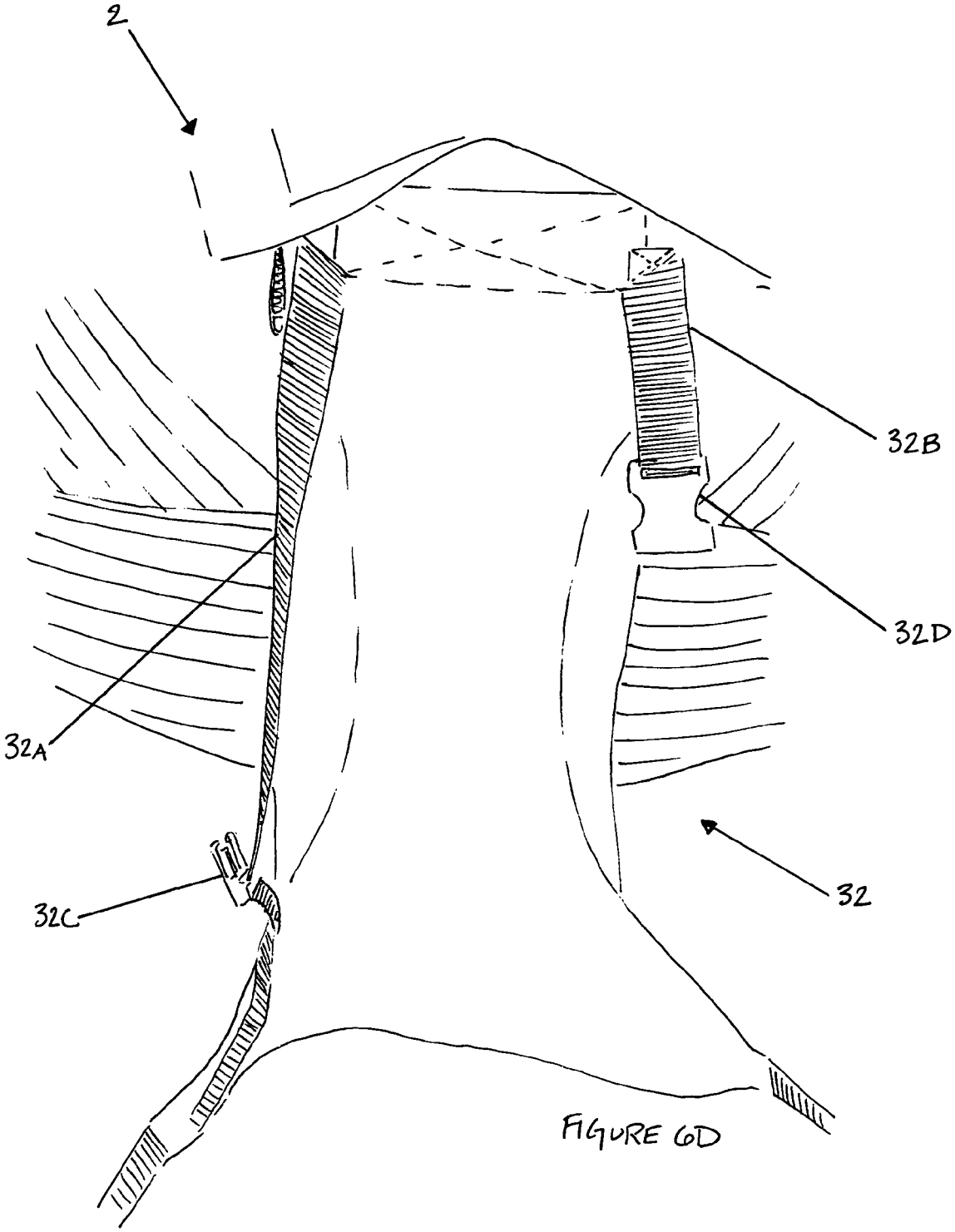
FIG. 6D is yet another view of the seat panel of FIG. 6A.

Referring now generally to the Figures and particularly to FIG. 6C and FIG. 6D, FIG. 6C and FIG. 6D are views of the seat panel 18 extending from the back panel 14 and positioned to receive the baby 4. A table cord 32 further extends from the seat pocket 20 of the pack panel 14. The table cord 32 optionally includes a right cord length 32A, a left cord length 32B and a cord coupling assembly 32C & 32D, the cord coupling assembly 32C & 32D for detachably coupling the right cord length 32A and the second cord length 32B.

The cord coupling assembly 32C & 32D may additionally enable the length adjustment of the cord 32. In certain alternate preferred embodiments of the present invention, the cord coupling assembly 32C & 32D may be a side squeeze buckle assembly, such as selected form a Stealth Warrior™ and Stealth Side™ side squeeze buckle assembly part number pair group of 6403 and 6404; 6358 and 6359; 6581 and 6583; 5614 and 5615; 5616 and 5617; DA003D and DA003K; and DA003Da and DA003Ka as distributed by John Howard Company of Chino, Calif., or other suitable detachable attachment paired elements known in the art.

The first carrier 2, to include the back panel 14, the waist strap 16, the seat fabric 18A, the head cover fabric 22, the adjustable band 30, the table cord 32, and the shoulder straps 8 & 10 may be made from or partly comprise various materials including canvas, nylon, synthetic fiber, or any type of suitable natural or artificial material or fibers known in the art and may include washable, deformable, and dryable materials. The seat fabric 18A may typically have the same shape as that shown in FIG. 5 and FIGS. 6A-6D, but may have other shapes, such as rectangular, hour-glass, or the like.

The securing devices 30C, 30D, 32C & 32D may be any type of suitable fastener known in the art, including variations of the male and female fasteners shown in FIGS. 6A-6D, VELCRO™ hook and loop fastener element, as marketed by Velcro USA, Inc. of Manchester, N.H., snap fastener stud and socket matched pairs, or the like. The securing devices 30C, 30D, 32C & 32D may be formed of organic or synthetic rubber, plastic, fabric, or the like.

Various elements 1-44 of the first carrier 2 may be attached respectively, by a piece of thread (i.e., sewing the pieces together), adhesives, glue, or various other items used to secure objects, particularly fabrics, together.

Figure 7:
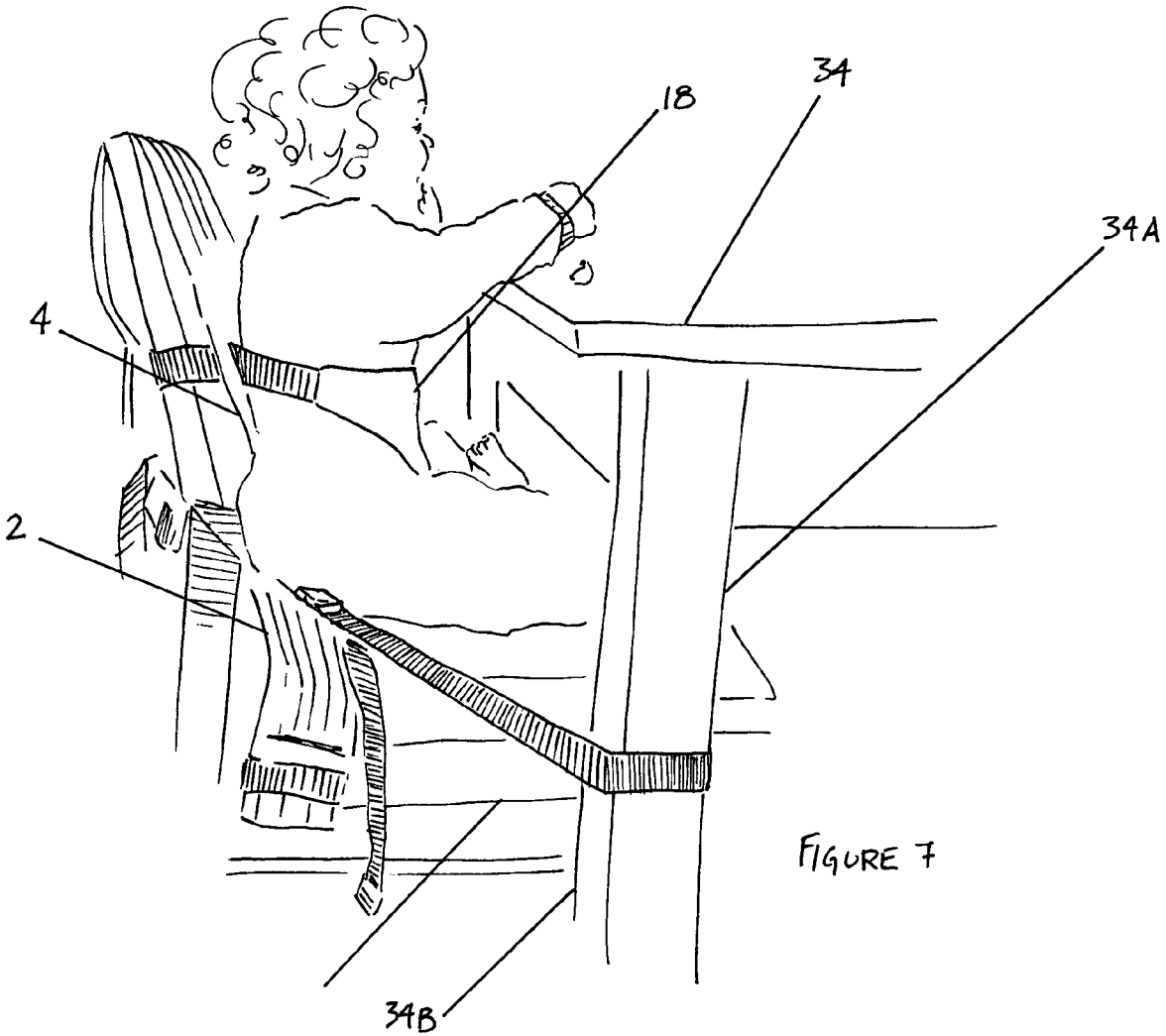
FIG. 7 is an illustration of a table cord of the first carrier deployed around a pair of legs of a table.

Referring now generally to the Figures and particularly to FIG. 7, FIG. 7 illustrates the table cord 32 deployed around legs 34A & 34B of a table 34, whereby the baby 4 is seated and secured within the seat panel 18 and the first carrier 2 is detachably coupled with both chair 12 by a combination of the shoulder straps 8 & 10, the waist strap 16 and the seat panel 18, and simultaneously detachably coupled with the table 34 by the table cord 32. The effective length of the table cord 32 that encompasses one or more table legs 34A & 34B may be adjusted by means of the varying the positions of the cord coupling assembly 32C & 32D along the right cord length 32A, a left cord length 32B.

Figure 8:
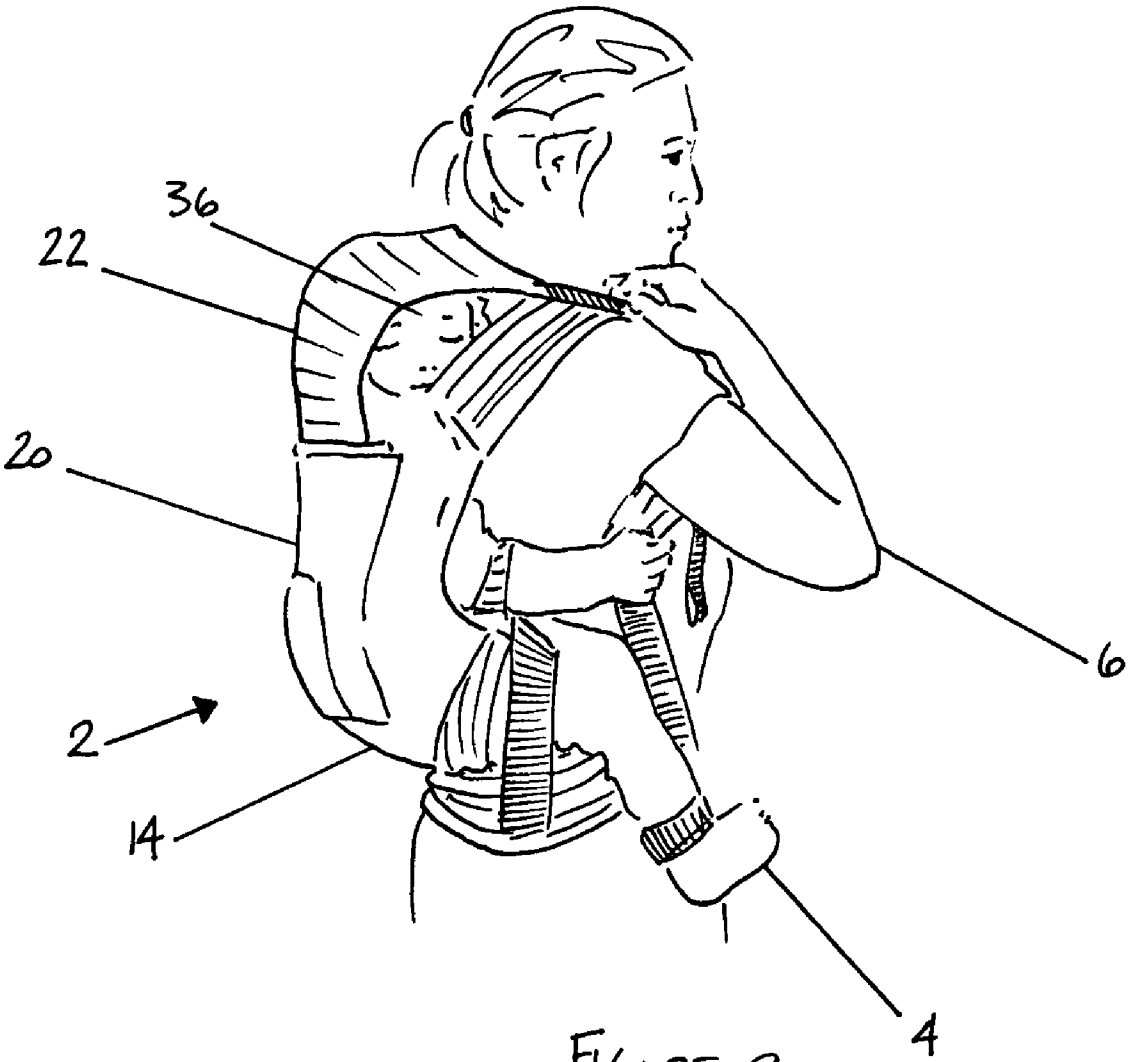
FIG. 8 is a perspective view of the first carrier with the first head cover deployed over a baby's head.

Referring now generally to the Figures and particularly to FIG. 8, FIG. 8 is a perspective view of the first carrier 2 with the head cover fabric 22 deployed over a baby's head 36. The head cover fabric 22 when deployed as shown in FIG. 8 reduces the free motion of the baby's head 36 and thereby reduces the possibility of neck strain by the baby 4 and further encourages the baby 4 to sleep while enclosed with the first carrier 2.

Figure 9:
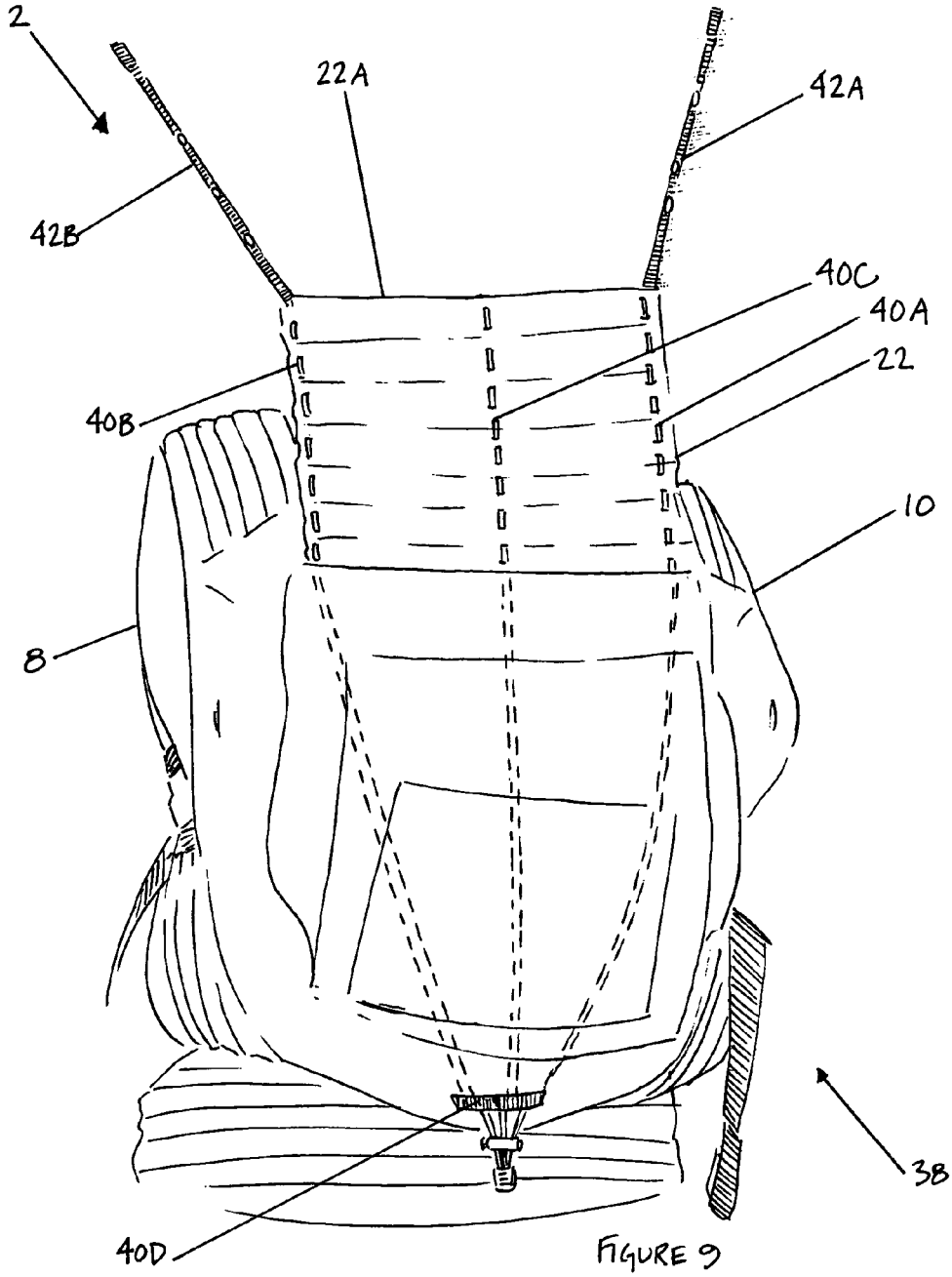
FIG. 9 illustrates a head cover assembly of FIG. 8.

Referring now generally to the Figures and particularly to FIG. 9, FIG. 9 illustrates ahead cover assembly 38 that includes the head cover fabric 22, a retracting cord 40A attached to a top edge 22A of the head cover fabric 22, a right pull strip 42A and a left pull strip 42B. The retracting cord 40A may further comprise additional retracting cords 40A & 40B. One or more retracting cords 40A-40C, the right pull strip 42A and/or the left pull strip 42B may be attached to a top edge 22A of the head cover fabric 22, by which attachment the wearer 6 may manipulate the positioning of the head cover fabric 22 relative to the baby's head 36. The retracting cord 40A may pass through a cord aperture 40D of the back panel 14, whereby the location of the cord aperture 40D is exposed to allow the wearer 6 to reach behind the exterior surface 14B, manually locate the retracting cord 40A & 40A-C to pull the retracting cord 40A in a direction away from the baby's head 36 and thereby pull the head cover fabric 22 totally away from the baby's head 36, or readjust the head cover fabric 22 in relation to the baby's head 36.

The wearer 4 may also use the right pull strip 42A and the left pull strip 42B to pull the head cover fabric 22 toward or over from the baby's head 36, or readjust the head cover fabric 22 in relation to the baby's head 36. As discussed below, the right pull strip 42A and the left pull strip 42B may additionally be used to secure the position of the head cover fabric 22 by detachable attachment to one or more shoulder straps 8 & 10.

Referring now generally to the Figures and particularly to FIG. 9, FIG. 9 illustrates a head cover assembly 38 that includes the head cover fabric 22, a retracting cord 40A attached to a top edge 22A of the head cover fabric 22, a right pull strip 42A and a left pull strip 42B. The retracting cord 40A may further comprise additional retracting cords 40A & 40B. One or more retracting cords 40A-40C, the right pull strip 42A and/or the left pull strip 42B may be attached to a top edge 22A of the head cover fabric 22, by which attachment the wearer 6 may manipulate the positioning of the head cover fabric 22 relative to the baby's head 36. The retracting cord 40A may pass through a cord aperture 40D of the back panel 14, whereby the location of the cord aperture 40D is exposed to allow the wearer 6 to reach behind the exterior surface 14B, manually locate the retracting cord 40A & 40A-C to pull the retracting cord 40A in a direction away from the baby's head 36 and thereby pull the head cover fabric 22 totally away from the baby's head 36, or readjust the head cover fabric 22 in relation to the baby's head 36.

The wearer 4 may also use the right pull strip 42A and the left pull strip 42B to pull the head cover fabric 22 toward or over from the baby's head 36, or readjust the head cover fabric 22 in relation to the baby's head 36. As discussed below, the right pull strip 42A and the left pull strip 42B may additionally be used to secure the position of the head cover fabric 22 by detachable attachment to one or more shoulder straps 8 & 10.

Figure 10:
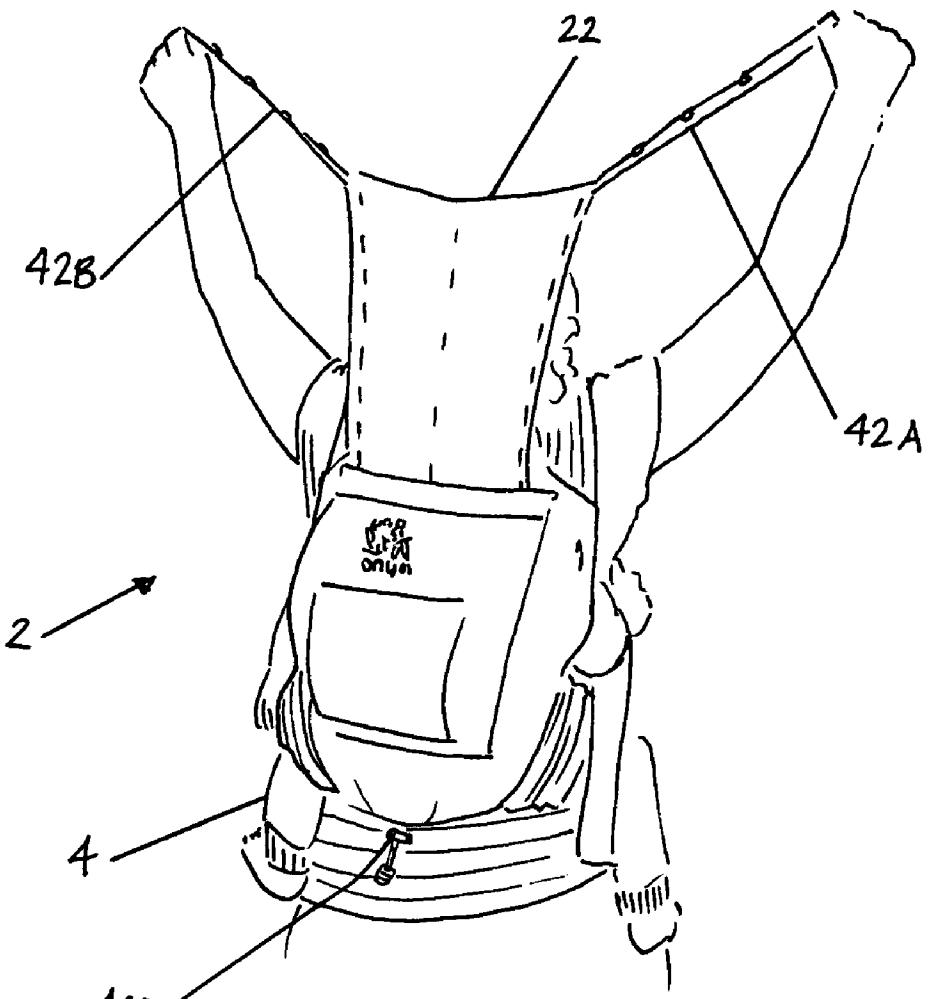
FIG. 10 is a perspective view of a wearer pulling a pair pull straps of FIG. 8 separately toward individual shoulder straps of the first carrier.

Referring now generally to the Figures and particularly to FIG. 10, FIG. 10 illustrates the wearer 6 manually pulling the right pull strip 42A and the left pull strip 42B out of the hood pocket 24 and for positioning in contact with and relative to the baby's head 36.

Figure 11:
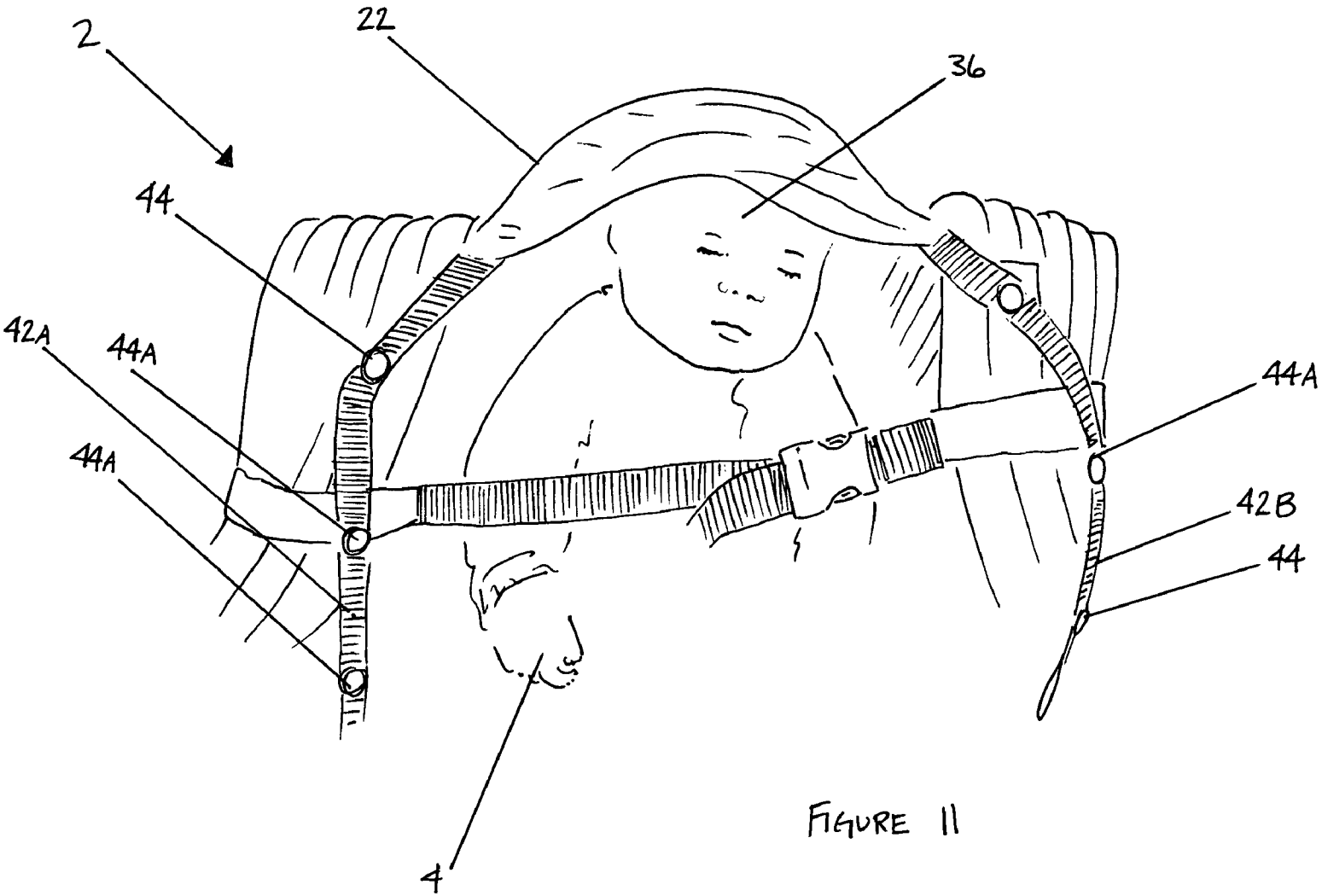
FIG. 11 is a view of a baby seated and secured within the first carrier an protected by the head cover assembly of FIGS. 8 through 10.

Referring now generally to the Figures and particularly to FIG. 11, FIG. 11 illustrates the baby 4 seated and secured within the first carrier 2 wherein the baby 4 is directly disposed between the wearer 6 and the interior side 14A of the back panel 14. A temporary attachment fixture 44 is formed by a temporary attachment of a snap fastener element 44A and a complementary snap fastener element 44B as manually effected by the wearer 6. For example, snap fastener element 44A may be a snap fastener stud and the complementary snap fastener element 44B may be a matching snap fastener socket.

Each of the pull strings 42A & 42B include a plurality of snap fixture elements 44A that may each be removably coupled with a complementary snap elements 44B (as shown in FIG. 4), wherein each complementary snap element 44B is located on one of the shoulder straps 8 &10. By selecting which snap fixture element 44A to temporarily connect with a selected complementary snap element 44B, the wearer can select how much tension to direct against the baby's head 36 to stabilize the baby's head 36.

Figure 12:
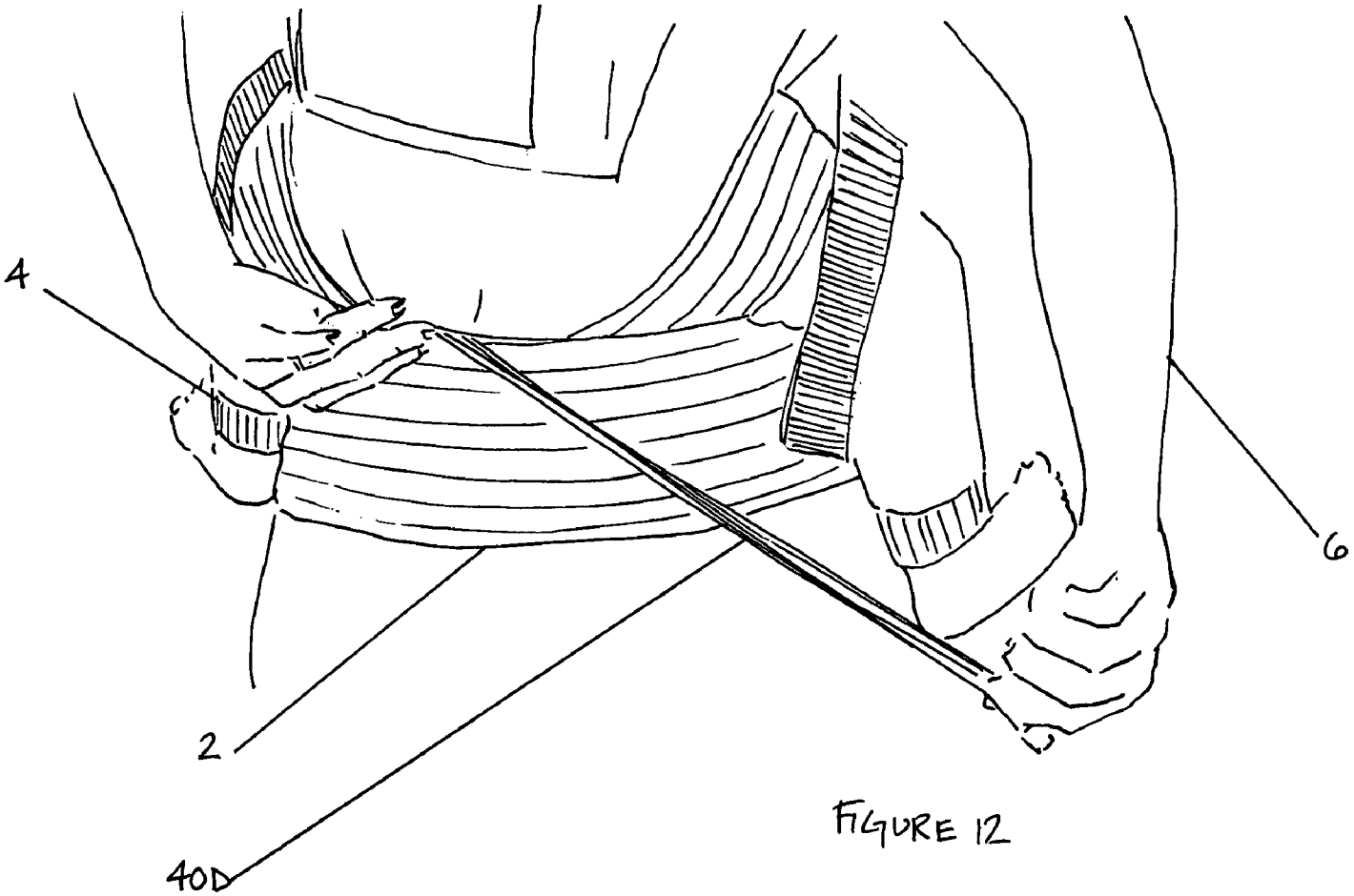
FIG. 12 is a view of a wearer of the first carrier pulling a retracting cord head cover assembly of FIGS. 8 through 10 to cause a head cover fabric to pull toward, and possibly into, the head cover pocket of FIGS. 1, 2 and 8 through 11, and away from a baby's head.

Referring now generally to the Figures and particularly to FIG. 12, FIG. 12 illustrates the wearer 6 pulling the retracting cord 40A-40C to cause the head cover fabric 22 to pull toward, and possibly into, the head cover pocket 24 and away from the baby's head 36.

The first carrier 2, to include the head cover assembly 38, the retracting cord 40A-40C, and the pull strings 42A & 42B may be made from or partly comprise various materials including canvas, nylon, synthetic fiber, or any type of suitable natural or artificial material or fibers known in the art and may include washable, deformable, and dryable materials.

The foregoing disclosures and statements are illustrative only of the present invention, and are not intended to limit or define the scope of the present invention. The above description is intended to be illustrative, and not restrictive. Although the examples given include many specificities, they are intended as illustrative of only certain possible applications of the present invention. The examples given should only be interpreted as illustrations of some of the applications of the present invention, and the full scope of the Present Invention should be determined by the appended claims and their legal equivalents. Those skilled in the art will appreciate that various adaptations and modifications of the just-described applications can be configured without departing from the scope and spirit of the present invention. Therefore, it is to be understood that the present invention may be practiced other than as specifically described herein. The scope of the present invention as disclosed and claimed should, therefore, be determined with reference to the knowledge of one skilled in the art and in light of the disclosures presented above.

I claim:

1. A device for protecting a child, the device comprising:

a. A back panel having a top edge, a bottom edge, a left edge and a right edge;

b. A right shoulder strap coupled at a right side of the top edge and a right side of the bottom edge;

c. A left shoulder strap coupled at a left side of the top edge and a left side of the bottom edge;

d. A seat panel coupled to an exterior side of the back panel and presenting a left leg aperture and a right leg aperture; and e. A retractable hood having a hood cloth and a retracting cord, the retractable hood coupled to the back panel and the retracting cord extending from a top edge of the hood cloth; and a hood pocket for enclosing the retractable hood in a retracted position, the hood pocket including an upper opening through which the hood extends and a cord aperture opposite the upper opening through which the retracting cord extends.

2. The device of claim 1, further comprising a right pull strip, the right pull strip coupled with the top edge of the hood cloth.

3. The device of claim 2, wherein the right pull strip includes a right fastener for removable coupling to the right shoulder strap.

4. The device of claim 2, wherein the right pull strip includes a plurality of right fasteners, each right fastener selectable for removable coupling to the right shoulder strap.

5. The device of claim 1, further comprising a left pull strip, the left pull strip coupled with the top edge of the hood cloth.

6. The device of claim 5, wherein the left pull strip includes a first left fastener for removable coupling to the left shoulder strap.

7. The device of claim 5, wherein the left pull strip includes a plurality of left fasteners, each left fastener selectable for removable coupling to the left shoulder strap.

8. The device of claim 5, further comprising a right pull strip, the right pull strip coupled with the top edge of the hood cloth.

9. The device of claim 8, wherein the left pull strip includes a first left fastener for removable coupling to the left shoulder strap and the right pull strip includes a right fastener for removable coupling with the right shoulder strap.

10. The device of claim 9, further comprising a hood pocket, the hood pocket configured to at least partially enclose the retractable hood.

11. The device of claim 10, the hood pocket further comprising a cord aperture, wherein the retracting cord extends from the top edge of the hood cloth and through the cord aperture.

12. A device for securing a child, the device comprising:

a. A back panel having an interior side, and exterior side, a top edge, a bottom edge, a left edge and a right edge;

b. A right shoulder strap coupled at a right side of the top edge and a right side of the bottom edge;

c. A left shoulder strap coupled at a left side of the top edge and a left side of the bottom edge; and d. A seat panel having an attached seat edge, a seat fabric presenting a securing edge, and an adjustable length band extending from the securing edge, the attached seat edge coupled to the back panel, and the adjustable length band in combination with the seat fabric securing edge encircling the back panel; a retractable hood having a hood cloth and a retracting cord, the retractable hood coupled to the back panel and the retracting cord extending from a top edge of the hood cloth; and a hood pocket for enclosing the retractable hood in a retracted position, the hood pocket including an upper opening through which the hood extends and a cord aperture opposite the upper opening through which the retracting cord extends.

13. The device of claim 12, the back panel further comprising a first panel aperture and a second panel aperture, and the seat panel adjustable band extending through the first panel aperture and the second panel aperture.

14. The device of claim 12, the back panel further comprising a seat panel pocket for at least partially enclosing the seat panel in a stowed position.

15. The device of claim 12, the adjustable band having a right band length, a left band length and a band coupling assembly, the band coupling assembly for detachably coupling the right band length and the second band length.

16. The device of claim 15, the back panel further comprising a first panel aperture and a second panel aperture, and the right band length extending through the first panel aperture and the left band length extending through the second panel aperture.

17. The device of claim 12, further comprising a table cord, the table cord attached to the back panel at a table cord panel end and for removably securing the device to an external feature.

18. The device of claim 17, the table cord having a right length, a left length and a cord coupling assembly, the cord coupling assembly for detachably coupling the right length and the second length.

19. A device for protecting a child, the device comprising:

a. A back panel;

b. A seat panel coupled to an exterior side of the back panel and presenting a left leg aperture and a right leg aperture; and c. A retractable hood having a hood cloth and a retracting cord, the retractable hood coupled to the back panel and the retracting cord extending from a top edge of the hood cloth; and a hood pocket for enclosing the retractable hood in a retracted position, the hood pocket including an upper opening through which the hood extends and a cord aperture opposite the upper opening through which the retracting cord extends.

* * * * *